US007755575B2

(12) United States Patent
Kim et al.

(10) Patent No.: US 7,755,575 B2
(45) Date of Patent: Jul. 13, 2010

(54) PLASMA DISPLAY APPARATUS

(75) Inventors: Chan Woo Kim, Gumi-si (KR); Seok Dong Kang, Gumi-si (KR)

(73) Assignee: LG Electronics Inc., Seoul (KR)

( * ) Notice: Subject to any disclaimer, the term of this patent is extended or adjusted under 35 U.S.C. 154(b) by 763 days.

(21) Appl. No.: 11/620,356

(22) Filed: Jan. 5, 2007

(65) Prior Publication Data

US 2007/0152916 A1 Jul. 5, 2007

(30) Foreign Application Priority Data

Jan. 5, 2006 (KR) ..... 10-2006-0001443

(51) Int. Cl.
*G09G 3/28* (2006.01)

(52) U.S. Cl. ..... 345/67

(58) Field of Classification Search ..... 345/60–68; 315/169.4

See application file for complete search history.

(56) References Cited

U.S. PATENT DOCUMENTS

| | | | | |
|---|---|---|---|---|
| 6,686,912 | B1 * | 2/2004 | Kishi et al. | 345/211 |
| 7,342,557 | B2 * | 3/2008 | Chung et al. | 345/60 |
| 7,576,709 | B2 * | 8/2009 | Chung et al. | 345/60 |
| 2002/0053882 | A1 | 5/2002 | Kanazawa | |
| 2003/0030598 | A1 * | 2/2003 | Kanazawa et al. | 345/60 |
| 2004/0252082 | A1 * | 12/2004 | Lacoste et al. | 345/63 |
| 2005/0156823 | A1 * | 7/2005 | Kang et al. | 345/60 |

FOREIGN PATENT DOCUMENTS

| | | |
|---|---|---|
| EP | 0 965 975 (A1) | 12/1999 |
| EP | 1 357 535 (A2) | 10/2003 |
| EP | 1 519 353 (A2) | 3/2005 |
| KR | 10-2002-0036682 | 5/2002 |
| KR | 10-2002-0066274 | 8/2002 |
| KR | 10-2003-0033245 | 5/2003 |
| KR | 10-2004-0007710 | 1/2004 |

OTHER PUBLICATIONS

Korean Office Action dated Jul. 11, 2007, on Korean Application No. 10-2006-0001443 (3 pages).
European Search Report dated Oct. 8, 2009 for Application No. 07250047.3, 6 pages.
Korean Office Action dated Mar. 29, 2007, on Korean Patent Application No. 10-2006-0001443, (3 pages).

* cited by examiner

*Primary Examiner*—Richard Hjerpe
*Assistant Examiner*—Sahlu Okebato
(74) *Attorney, Agent, or Firm*—Fish & Richardson P.C.

(57) ABSTRACT

Provided is a plasma display apparatus. The plasma display apparatus includes a first electrode and a second electrode formed in parallel on an upper substrate, and a third electrode formed on a lower substrate to intersect with the first electrode and the second electrode. A driving signal is applied to the first electrode, the second electrode, and the third electrode in a reset period, an address period, and a sustain period per one subfield. The reset period comprises a setdown period. A difference between a setdown lowest voltage of the driving signal applied to the first electrode and a voltage applied to the second electrode in the setdown period is 1.2 times to 1.5 times of a sustain voltage.

20 Claims, 13 Drawing Sheets

PLASMA DISPLAY APPARATUS

This Nonprovisional application claims priority under 35 U.S.C. §119(a) on Patent Application No. 10-2006-0001443 filed in Korea on Jan. 5, 2006, the entire contents of which are hereby incorporated by reference.

BACKGROUND OF THE INVENTION

1. Field of the Invention

The present invention relates to a plasma display apparatus, and more particularly, to a plasma display apparatus for limiting a difference between a lowest voltage of a setdown reset signal and a sustain bias voltage in a period for supplying the setdown reset signal, thereby preventing generation of a residual image spot.

2. Description of the Background Art

Plasma display panel (PDP) refers to a device for displaying an image including a character or a graphic by applying a predetermined voltage to electrodes provided in a discharge space, inducing a discharge, and exciting a phosphor using plasma generated upon gas discharge. The plasma display panel has an advantage of facilitating its large-sizing, slimness, and thinning, providing a wide viewing angle in the omni direction, and realizing a full color and a high luminance.

Long time driving of the plasma display apparatus reduces a discharge initiation voltage because of impure gas or contaminant particles existing within the plasma display apparatus, or an irregular distribution of wall charges.

The reduction of the discharge initiation voltage causes a drawback of inducing an erroneous discharge such as turning on a cell to turn off, and generating a spot because of a sustain discharge even without an address discharge. In particular, in case where an image is converted into a different image after being continuously displayed, there is a drawback of generating a residual image spot in which the spot is generated in a residual image portion.

SUMMARY OF THE INVENTION

Accordingly, the present invention is to solve at least the problems and disadvantages of the background art.

The present invention is to provide a plasma display apparatus for limiting a difference between a lowest setdown voltage and a sustain bias voltage to a predetermined range, thereby preventing an erroneous discharge, and improving a residual image spot.

To achieve these and other advantages and in accordance with the purpose of the present invention, as embodied and broadly described, there is provided a plasma display apparatus. The plasma display apparatus includes a first electrode and a second electrode formed in parallel on an upper substrate, and a third electrode formed on a lower substrate to intersect with the first electrode and the second electrode. A driving signal is applied to the first electrode, the second electrode, and the third electrode in a reset period, an address period, and a sustain period per one subfield. The reset period comprises a setdown period. A difference between a setdown lowest voltage of the driving signal applied to the first electrode and a voltage applied to the second electrode in the setdown period is 1.2 times to 1.5 times of a sustain voltage.

In another aspect of the present invention, there is provided a plasma display apparatus. A driving signal is applied to the first electrode, the second electrode, and the third electrode in a reset period, an address period, and a sustain period per one subfield. The reset period is comprised of only a setdown period without a setup period. A difference between a setdown lowest voltage of the driving signal applied to the first electrode and a voltage applied to the second electrode in the setdown period is 1.2 times to 1.5 times of a sustain voltage.

In a further another aspect of the present invention, there is provided a plasma display apparatus. A driving signal is applied to the first electrode, the second electrode, and the third electrode in a reset period comprising a setdown period, an address period, and a sustain period per one subfield. A difference between a setdown lowest voltage of the driving signal applied to the first electrode and a voltage applied to the second electrode in the setdown period is 1.2 times to 1.5 times of a sustain voltage. The setdown lowest voltage is substantially the same as a scan pulse voltage.

An absolute value of the setdown lowest voltage may be half of or less than the sustain voltage.

An absolute value of the voltage applied to the second electrode may be the sustain voltage or less.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
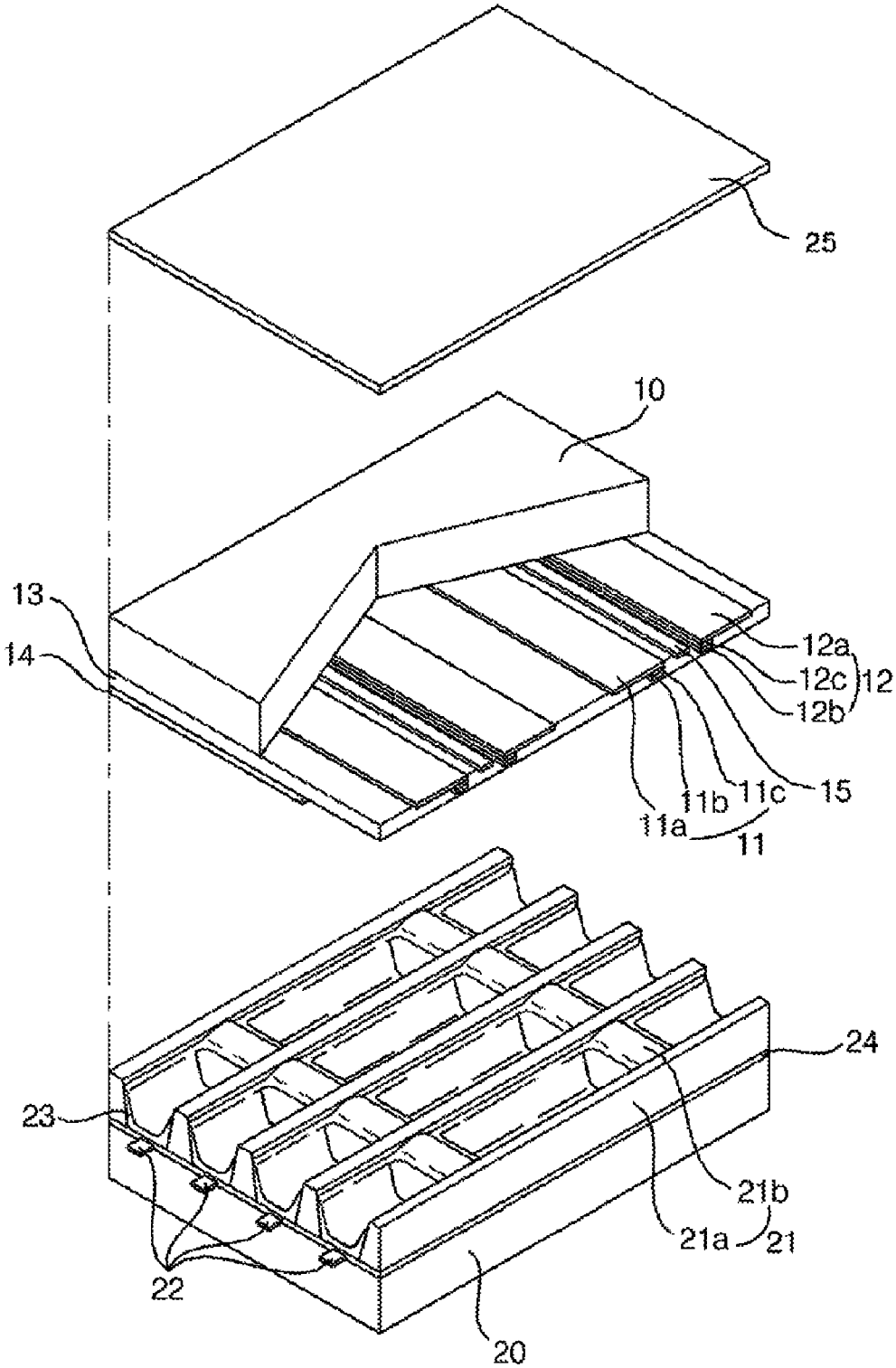
FIG. 1 is a perspective diagram illustrating a structure of a plasma display apparatus according to an exemplary embodiment of the present invention.

Preferred embodiments of the present invention will be described in a more detailed manner with reference to the drawings. FIG. 1 is a perspective diagram illustrating a structure of a plasma display apparatus according to an exemplary embodiment of the present invention.

As shown in FIG. 1, the plasma display apparatus includes a scan electrode 11 and a sustain electrode 12 that constitute a sustain electrode pair formed on an upper substrate 10; and an address electrode 22 formed on a lower substrate 20.

The sustain electrode pair 11 and 12 includes transparent electrodes 11*a* and 12*a*, and bus electrodes 11*b* and 12*b*. The transparent electrodes 11*a* and 12*a* are formed of Indium-Tin-Oxide (ITO). The bus electrodes 11*b* and 12*b* can be formed of metal such as silver (Ag) and chrome (Cr). Alternately, the bus electrodes 11*b* and 12*b* can be of laminate type based on chrome/copper/chrome (Cr/Cu/Cr) or chrome/aluminum/chrome (Cr/Al/Cr). The bus electrodes 11*b* and 12*b* are formed on the transparent electrodes 11*a* and 12*a*, and reduce a voltage drop caused by the transparent electrodes 11*a* and 12*a* having high resistances. It is desirable that a distance between the transparent electrodes 11*a* and 12*a* for maximizing a discharge efficiency in sustain electrode discharge is within a range of 90 μm to 150 μm.

In an exemplary embodiment of the present invention, the sustain electrode pair 11 and 12 can be of a structure in which the transparent electrodes 11*a* and 12*a* and the bus electrodes 11*b* and 12*b* are laminated, as well as can be of a structure based on only the bus electrodes 11*b* and 12*b*, excluding the transparent electrodes 11*a* and 12*a*. This structure is advantageous of reducing a panel manufacture cost because it does not use the transparent electrodes 11*a* and 12*a*. The bus electrodes 11*b* and 12*b* used for this structure can be formed of diverse materials such as photosensitive material in addition to the above-described materials.

A Black Matrix (BM) 15 is provided between the transparent electrodes 11*a* and 12*a* and the bus electrodes 11*b* and 12*b* of the scan electrode 11 and the sustain electrode 12. The black matrix 15 performs a light shield function of absorbing external light emitting from an outside of the upper substrate 10 and reducing reflection, and a function of improving purity and contrast of the upper substrate 10.

In an exemplary embodiment of the present invention, the black matrix 15 is formed on the upper substrate 10. The black matrix 15 can be comprised of a first black matrix 15, and second black matrixes 11*c* and 12*c*. The first black matrix 15 is formed in a position where it overlaps with a barrier rib 21. The second black matrixes 11*c* and 12*c* are formed between the transparent electrodes 11*a* and 12*a* and the bus electrodes 11*b* and 12*b*. The first black matrix 15, and the second black matrixes 11*c* and 12*c* (called black layers or black electrode layers) can be concurrently formed in their forming processes, physically connecting with each other. Alternately, the first black matrix 15 and the second black matrixes 11*c* and 12*c* are not concurrently formed, physically disconnecting with each other.

The black matrix 15 and the second black matrixes 11*c* and 12*c* are formed of the same material in case where they physically connect with each other. However, the black matrix and the second black matrixes 11*c* and 12*c* are formed of different materials in case where they physically disconnect from each other.

An upper dielectric layer 13 and a protective film 14 are layered on the upper substrate 10 where the scan electrode 11 and the sustain electrode 12 are formed in parallel with each other. Charged particles generated by discharge are accumulated on the upper dielectric layer 13. The upper dielectric layer 13 can protect the sustain electrode pair 11 and 12. The protective film 14 protects the upper dielectric layer 13 against sputtering of the charged particles generated by the gas discharge. The protective film 14 enhances an efficiency of emitting secondary electrons.

The address electrode 22 is formed in the direction of intersecting with the scan electrode 11 and the sustain electrode 12. A lower dielectric layer 24 and the barrier rib 21 are formed on the lower substrate 20 including the address electrode 22. A phosphor layer 23 is formed on surfaces of the lower dielectric layer 24 and the barrier rib 21.

The barrier rib 21 includes a horizontal barrier rib 21*b* and a vertical barrier rib 21*a* that are formed in a closed type. The horizontal barrier rib 21*b* is formed in the same direction as the sustain electrodes 11 and 12 of the upper substrate 10. The vertical barrier rib 21*a* is formed in the different direction from the horizontal barrier rib 21*b*. The barrier rib 21 physically distinguishes discharge cells, and prevents ultraviolet rays and visible rays generated by the discharge from leaking to neighbor cells.

Referring to FIG. 1, a filter 25 is formed in front of a plasma display panel according to the present invention. The filter 25 can include an external light shield layer, an Anti-Reflection (AR) layer, a Near InfraRed (NIR) shield layer, or an ElectroMagnetic Interference shield layer.

When a gap between the filter 25 and the plasma display panel is about 10 μm to 30 μm, light incident from the external can be effectively shielded, and light emitted from the panel can be effectively emitted to the external. In order to protect the panel from a pressure from the external, the gap between the filter 25 and the panel can be about 30 μm to 120 μm.

An adhesive layer can be formed between the filter 25 and the panel, and adhere to the filter 25 and the panel.

In an exemplary embodiment of the present invention, the barrier rib 21 can have various shaped structures as well as a structure shown in FIG. 1. For example, there are a differential type barrier rib structure, a channel type barrier rib structure, and a hollow type barrier rib structure. In the differential type barrier rib structure, the vertical barrier rib 21*a* and the horizontal barrier rib 21*b* are different in height. In the channel type barrier rib structure, a channel available for an exhaust passage is provided for at least one of the vertical barrier rib 21*a* and the horizontal barrier rib 21*b*. In the hollow type barrier rib structure, a hollow is provided for at least one of the vertical barrier rib 21*a* and the horizontal barrier rib 21*b*.

It is desirable that the horizontal barrier rib 21*b* is great in height in the differential type barrier rib structure. It is desirable that the horizontal barrier rib 21*b* has the channel or hollow in the channel type or hollow type barrier rib structure.

In an exemplary embodiment of the present invention, it is shown and described that each of Red (R), Green (G), and Blue (B) discharge cells is arranged on the same line. Alternatively, the R, G, and B discharge cells can be arranged in a different type. For example, there is a delta type arrangement where the R, G, and B discharge cells are arranged in a triangular shape. The discharge cell can have a rectangular shape as well as a polygonal shape such as a pentagonal shape and a hexagonal shape.

The phosphor layer 23 is excited by the ultraviolet rays generated by the gas discharge, and emits any one visible ray among Red (R), Green (G), and Blue (B). An inertia mixture gas such as helium plus xenon (He+Xe), neon plus xenon (Ne+Xe), and helium plus neon plus xenon (He+Ne+Xe) is injected for the discharge into a discharge space provided between the front and lower substrates 10 and 20 and the barrier rib 21.

Figure 2:
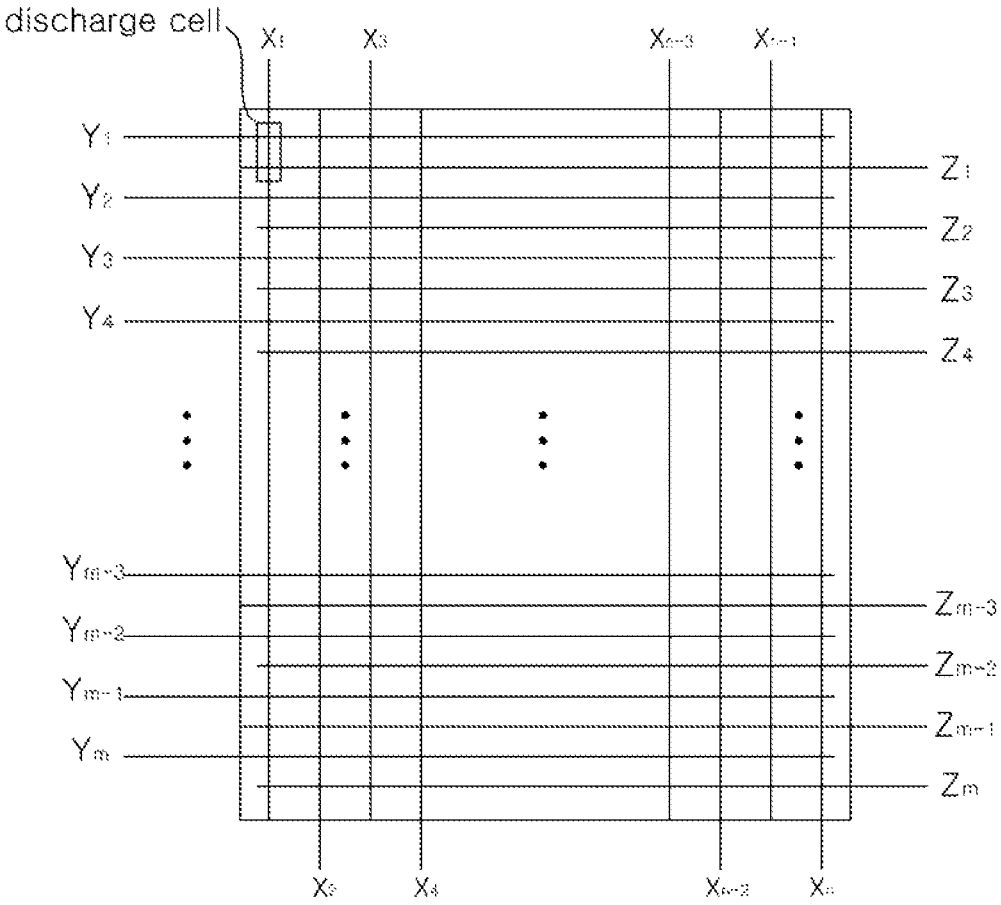
FIG. 2 is a diagram illustrating an electrode arrangement of a plasma display apparatus according to an exemplary embodiment of the present invention.

FIG. 2 is a diagram illustrating an electrode arrangement of the plasma display panel according to an exemplary embodiment of the present invention. It is desirable that a plurality of discharge cells constituting the plasma display panel are arranged in matrix form as shown in FIG. 2.

The plurality of discharge cells are provided at intersections of the scan electrode lines (Y1 to Ym) and the sustain electrode lines (Z1 to Zm), and the address electrode lines (X1 to Xn), respectively. The scan electrode lines (Y1 to Ym) can be driven sequentially or simultaneously. The sustain electrode lines (Z1 to Zm) can be driven simultaneously. The address electrode lines (X1 to Xn) can be divided into odd-numbered lines and even-numbered lines and driven, or can be driven sequentially.

The electrode arrangement of FIG. 2 is merely exemplary for the plasma display apparatus according to the present invention. Thus, the present invention is not limited to the electrode arrangement of the plasma display panel of FIG. 2 and a driving method thereof. For example, the present invention can also provide a dual scan method for simultaneously driving two ones among the scan electrode lines (Y1 to Ym). Also, the address electrode lines (X1 to Xn) can be also divided up/down and driven in the center of the panel.

Figure 3:
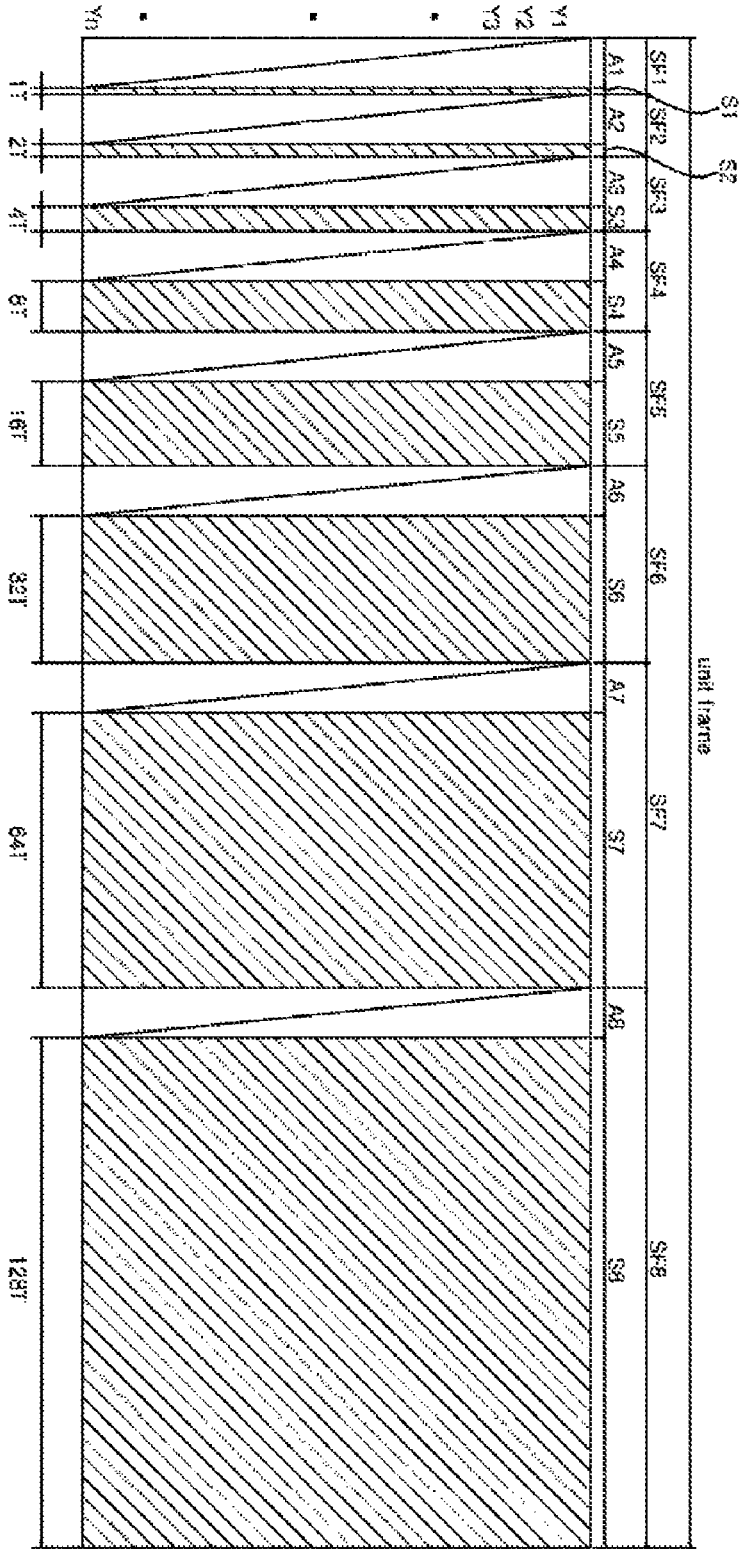
FIG. 3 is a timing diagram illustrating a method for time-division driving a plasma display apparatus by dividing one frame into a plurality of subfields according to an exemplary embodiment of the present invention.

FIG. 3 is a diagram illustrating a method of time-division driving the plasma display apparatus by dividing one frame into a plurality of subfields according to an exemplary embodiment of the present invention. Referring to FIG. 3, a unit frame can be divided into a predetermined number of subfields, e.g. eight subfields (SF1, . . . , SF8) to realize a time-division gray scale. Each subfield (SF1, . . . , SF8) is divided into a reset period (not shown), an address period (A1, . . . , A8), and a sustain period (S1, . . . , S8).

In an exemplary embodiment of the present invention, the reset period can be omitted from at least one of the plurality of subfields. For example, the reset period can exist only at a first subfield, or can exist only at the first field and an approximately middle subfield among the whole subfield.

During each address period (A1, . . . , A8), an address signal is applied to the address electrode (X), and a scan signal associated with each scan electrode (Y) is sequentially applied to each scan electrode line.

During each sustain period (S1, . . . , S8), a sustain signal is alternately applied to the scan electrode (Y) and the sustain electrode (Z), thereby inducing a sustain discharge in the discharge cell having wall charges formed in the address periods (A1, . . . , A8).

In the plasma display panel, luminance is proportional to the number of sustain discharge pulses within the sustain discharge periods (S1, . . . , S8) of the unit frame. In case where one frame constituting one image is expressed by 8 subfields and 256 gray scales, the sustain signals different from each other can be assigned to each subfield in a ratio of 1:2:4:8:16:32:64:128 in regular sequence. The cells are addressed and the sustain discharges are performed during the subfield1 (SF1), the subfield3 (SF3), and the subfield8 (SF8) so as to acquire luminance based on 133 gray scales.

The number of sustain discharges assigned to each subfield can be variably decided depending on subfield weights based on an Automatic Power Control (APC) level. In detail, the present invention is not limited to the exemplary description of FIG. 3 where one frame is divided into eight subfields, and can variously modify the number of subfields constituting one frame depending on a design specification. For example, one frame can be divided into 8 subfields or more like 12 subfields or 16 subfields to drive the plasma display panel.

The number of sustain discharges assigned to each subfield can be diversely modified considering a gamma characteristic or a panel characteristic. For example, a gray scale assigned to the subfield4 (SF4) can decrease from 8 to 6, and a gray scale assigned to the subfield6 (SF6) can increase from 32 to 34.

Figure 4A:
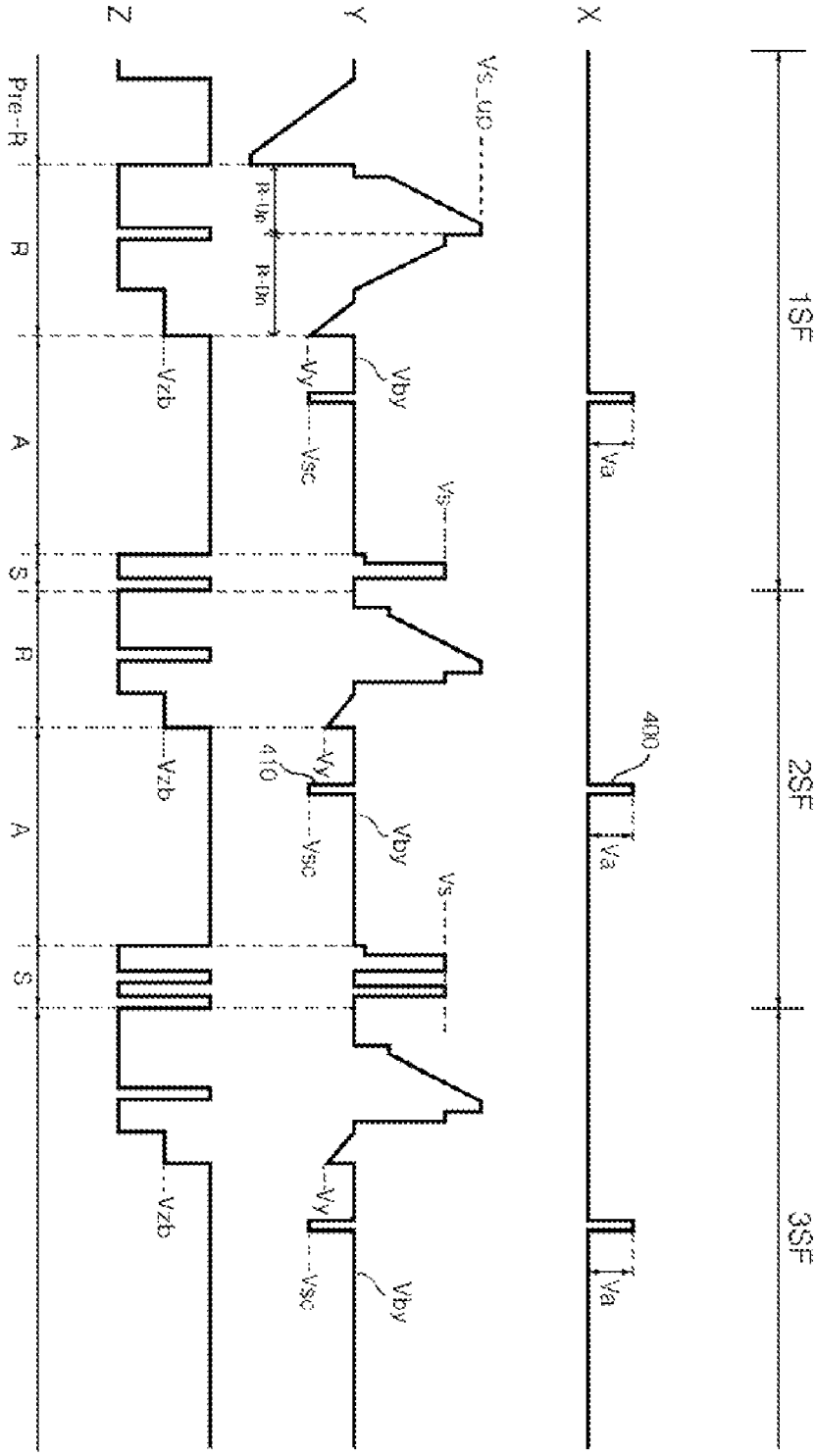
FIGS. 4A to 4E are diagrams illustrating signals for driving a plasma display apparatus for one divided subfield according to an exemplary embodiment of the present invention.

FIG. 4A is a timing diagram illustrating a signal for driving the plasma display apparatus for one divided subfield according to an exemplary embodiment of the present invention.

The subfield includes the reset period for initializing the discharge cells of a whole screen; the address period for selecting the discharge cell; and the sustain period for sustaining the discharge of the selected discharge cell.

A three-electrode surface discharge plasma display panel includes a scan electrode, a sustain electrode, and an address electrode. The first electrode is called a scan electrode (Y), the second electrode is called a sustain electrode (Z), and the third electrode is called an address electrode (X) for description in this specification.

The reset period (R) is comprised of a setup period (R-Up) and a setdown period (R-Dn). During the setup period (R-Up), a ramp-up waveform (R_up) is concurrently applied to all the first electrodes (Y), thereby inducing a weak discharge in all the discharge cells and thus generating the wall charges. During the setdown period (R-Dn), a ramp-down waveform (R_dn), which is a setdown reset signal ramping down from a positive voltage lower than a peak voltage of the ramp-up waveform (R_up), is concurrently applied to all the first electrodes (Y), thereby inducing an erase discharge in all the discharge cells and thus erasing unnecessary charges from space charges and the wall charges that are generated by the setup discharge.

A lowest voltage of the setdown reset signal (R_dn) in the setdown period (R-Dn) is called a setdown lowest voltage (Vy) in this specification.

In the setdown period (R-Dn), a ground (GND) voltage is applied to the third electrode (X), and a bias voltage is applied to the second electrode (Z) to intensify a discharge induced during the reset period (R). The bias voltage applied to the second electrode (Z) is called a sustain bias voltage (Vzb) for description convenience in this specification.

When the address period (A) initiates, a scan bias voltage (Vby) is applied to the first electrode (Y).

After that, a negative (−) scan pulse is sequentially applied to the first electrode (Y). A positive (+) data pulse is synchronized with the scan pulse, and is applied to the third electrode (X) in the discharge cell to induce the discharge.

A voltage difference between the data pulse and the scan pulse induces an address discharge in the discharge cell in which the scan pulse is applied to the first electrode (Y) and the data pulse is applied to the third electrode (X) intersecting with the first electrode (Y).

During the address period (A), the sustain bias voltage (Vzb) is applied to the second electrode (Z), and is sustained.

During the sustain period (S), a sustain pulse is alternately supplied to the first electrode (Y) and the second electrode (Z). The sustain discharge is induced in the discharge cell where the address discharge is induced, thereby displaying an image brighter by the number of times of the sustain discharge. A highest voltage of the sustain pulse is called a sustain voltage (Vs) for description in this specification.

In the plasma display apparatus according to a first exemplary embodiment of the present invention, the reset period is comprised of the setup period (R-Up) and the setdown period (R-Dn). A difference between the setdown lowest voltage (Vy) applied to the first electrode (Y) and the sustain bias voltage (Vzb) applied to the second electrode (Z) in the setdown period is set about 1.2 to 1.5 times of the sustain voltage (Vs).

When the setdown lowest voltage (Vy) has a negative (−) voltage within a range of about −70 V to −110 V, the sustain bias voltage (Vzb) has a positive (+) voltage within a range of about 140 V to 170 V, and the sustain voltage (Vs) has a positive (+) voltage within a range of about 170 V to 190 V, the difference between the setdown lowest voltage (Vy) and the sustain bias voltage (Vzb) is within a range of about 210 V to 280 V.

It is desirable that the difference between the setdown lowest voltage and the sustain bias voltage is set within a range of about 204 V to 255 V to prevent the residual image spot, when the sustain voltage (Vs) is 170 V.

A numerical value of the difference between the setdown lowest voltage (Vy) and the sustain bias voltage (Vzb) is exemplary and thus, is not limited to this specification. The numerical value can vary depending on the setdown lowest voltage and the sustain bias voltage used to drive the plasma display apparatus. However, the difference between the setdown lowest voltage and the sustain bias voltage should be set within a range of about 1.2 Vs to 1.5 Vs.

It is desirable that an absolute value of the setdown lowest voltage (Vy) is set half of or less than the sustain voltage (Vs). The sustain bias voltage (Vzb) is set smaller than the sustain voltage (Vs). If the absolute value of the setdown lowest voltage (Vy) is greater than the half of the sustain voltage (Vs), or the sustain bias voltage (Vzb) is greater than the sustain voltage (Vs), there occurs a drawback that an erroneous discharge is induced or a charge distribution required for the discharge is not formed in orderly fashion.

An absolute value of the sustain bias voltage (Vzb) applied to the second electrode (Z) is a value of the sustain voltage (Vs) or less. When the sustain bias voltage (Vzb) is greater than the sustain voltage (Vs), the erroneous discharge is induced during the address period or a wall charge distribution required for the address discharge is not formed, thereby not inducing a required discharge.

Figure 4B:
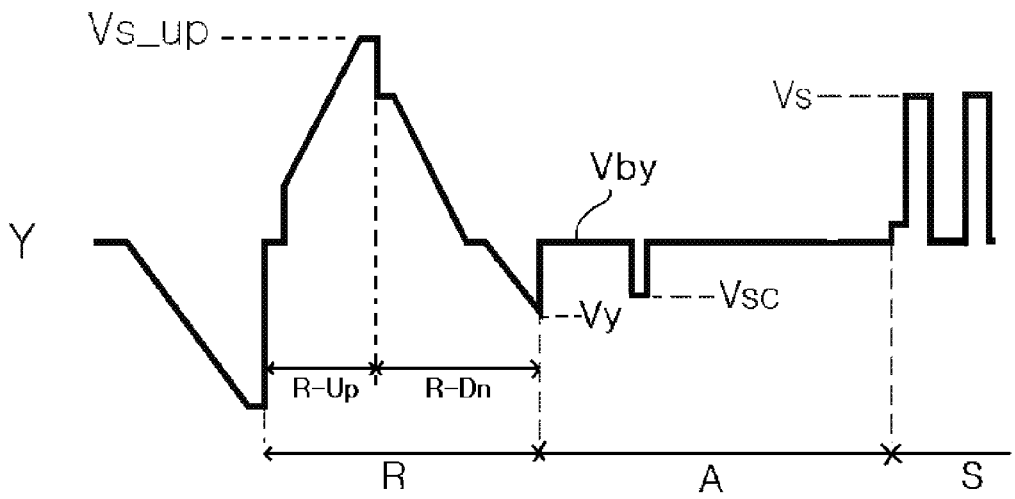

The setdown lowest voltage (Vy) applied to the first electrode (Y) can be equal in magnitude to a scan pulse voltage (Vsc) as in a first subfield of FIG. 4A, or can be greater in magnitude than the scan pulse voltage (Vsc) as shown in FIG. 4B.

The sustain bias voltages (Vzb) applied to the second electrode (Z) can be different from each other in the setdown period (R-Dn) and the address period (A). The sustain bias voltage (Vzb) can be also provided at several levels even in the address period (A).

As shown in FIG. 4A, the setdown lowest voltages (Vy) can be different in magnitude in the first subfield (1SF) and a second subfield (2SF).

In other words, the setdown lowest voltages (Vy) can be different from each other in magnitude in two arbitrary subfields.

Figure 4C:
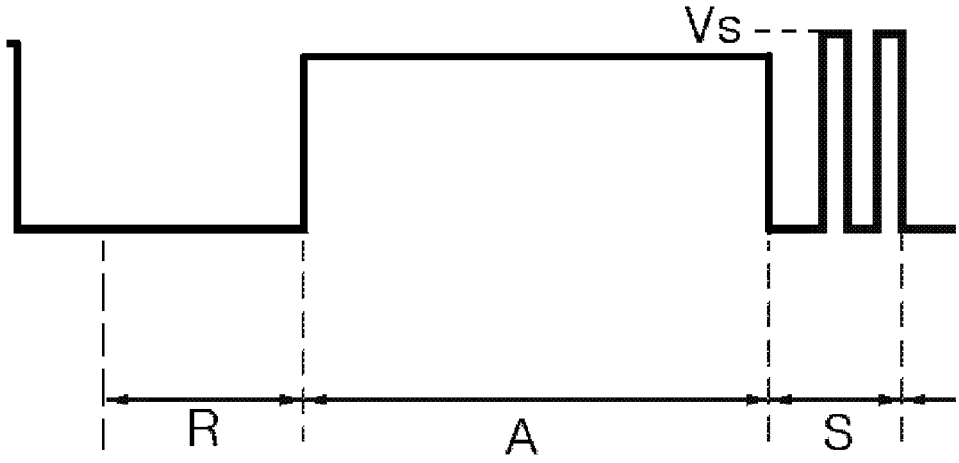
Figure 4D:
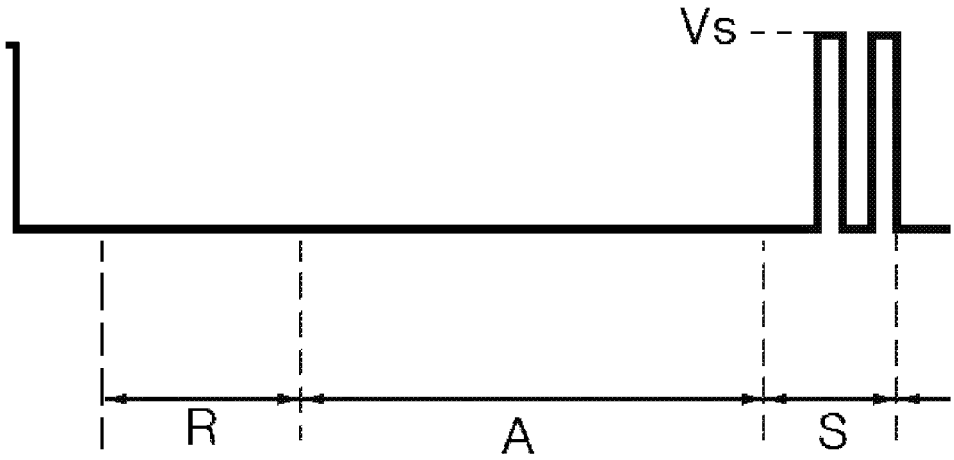

Referring to FIG. 4C, the sustain bias voltage (Vzb) applied to the second electrode (Z) can be the ground voltage in the setdown period. As shown in FIG. 4D, the ground voltage can be applied as the bias voltage even in the address period.

Figure 4E:
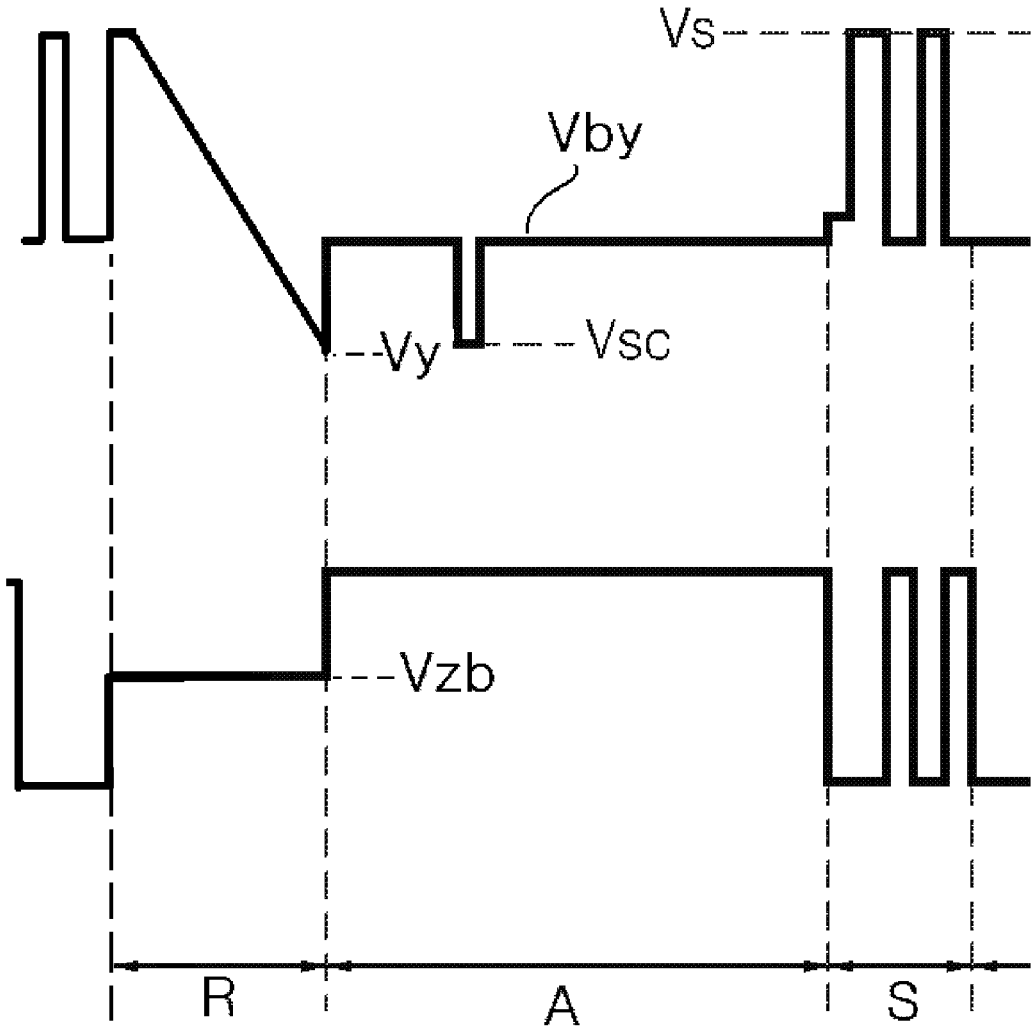

Referring to FIG. 4E, a plasma display apparatus according to a second exemplary embodiment of the present invention is characterized in that a reset period (R) is comprised of only a setdown period (R-Dn) without a setup period, and a difference between a setdown lowest voltage (Vy) of a driving signal applied to a first electrode (Y) and a sustain bias voltage (Vzb) applied to a second electrode (Z) in the setdown period (R-Dn) is about 1.2 times to 1.5 times of a sustain voltage (Vs).

The reset period (R) comprised of only the setdown period (R-Dn) is applicable to any one of several subfields.

For example, the reset period (R) includes the setup period in a first subfield, but can include only the setdown period without the setup period in second and subsequent subfields.

Though there is provided only the setdown period without the setup period in at least one subfield as above, a discharge cell can be not only initialized but also a driving time margin can increase, thereby making advantageous to driving, particularly, single scan driving.

Other constructions are substantially the same as those of the first exemplary embodiment of the present invention.

The driving waveforms of FIGS. 4A to 4E are examples of the signals for driving the plasma display apparatus according to the present invention. The driving waveforms of FIGS. 4A to 4E are not intended to limit the scope of the present invention. For example, a pre reset period (Pre-R) can be omitted, and the driving signals of FIGS. 4A to 4E can change in polarity and voltage according to need. After completion of the sustain discharge, an erase signal for erasing wall charges can be also applied to the sustain electrode. Single sustain driving can be also enabled by applying the sustain signal to any one of the scan electrode (Y) and the sustain electrode (Z), thereby inducing the sustain discharge.

However, the difference between the setdown lowest voltage (Vy) of the driving signal applied to the first electrode (Y) and the sustain bias voltage (Vzb) applied to the second electrode in the setdown period (R-Dn) should be about 1.2 times to 1.5 times of the sustain voltage (Vs).

A procedure of preventing the residual image spot according to exemplary embodiments of the present invention will be described below.

Figure 5:
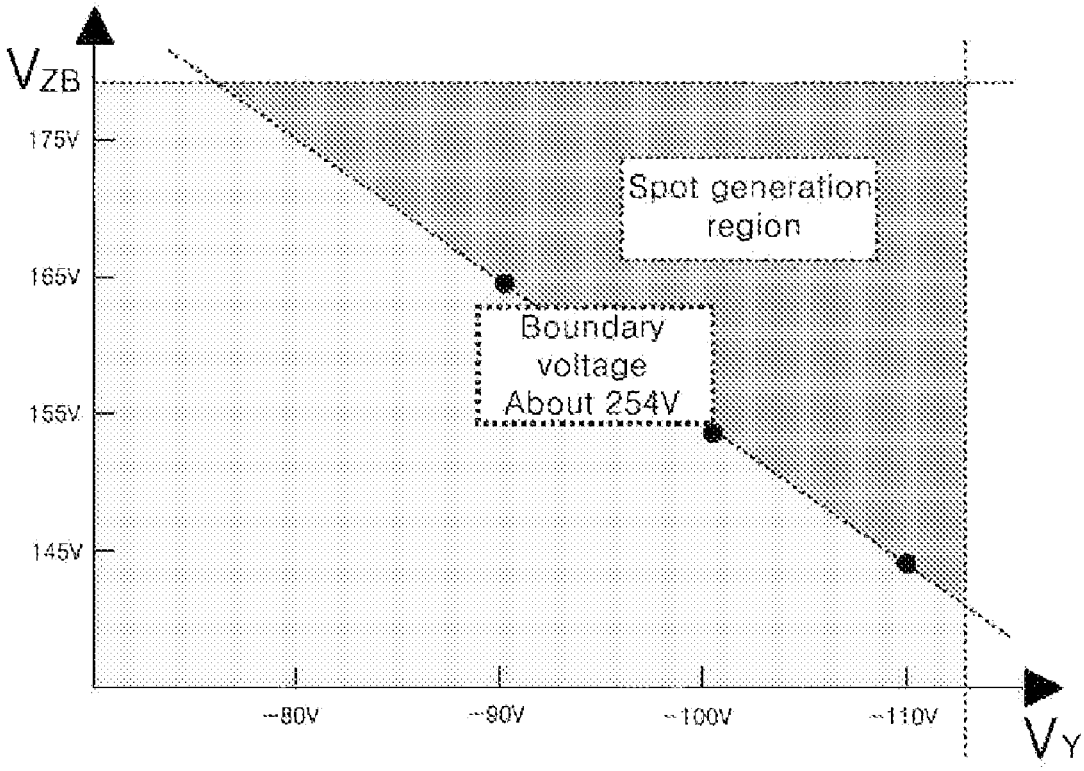
FIG. 5 illustrates an example of a spot generation region depending on a setdown lowest voltage and a sustain bias voltage.

FIG. 5 illustrates an example of a spot generation region depending on the setdown lowest voltage and the sustain bias voltage.

As shown in FIG. 5, in case where the setdown lowest voltage (Vy) changes from −80 V to −110 V and the sustain bias voltage (Vzb) changes from 145 V to 175 V, the residual image spot is not generated at the sustain voltage of about 165 V when the difference between the setdown lowest voltage (Vy) and the sustain bias voltage (Vzb) is less than about 245 V. However, the residual image spot is generated when the difference between the setdown lowest voltage and the sustain bias voltage is about 245 V or more.

A high voltage of 300 V or more is required for driving the plasma display panel but, actually, the setdown lowest voltage (Vy) and the sustain bias voltage (Vzb) are applied, thereby implementing voltage compensation after a reset discharge to induce a discharge at about 165 V.

Thus, the plasma display apparatus should be constructed so that the spot is not generated within a range of about 165 V to 180 V that is a driving voltage of the plasma display panel.

Figure 6A:
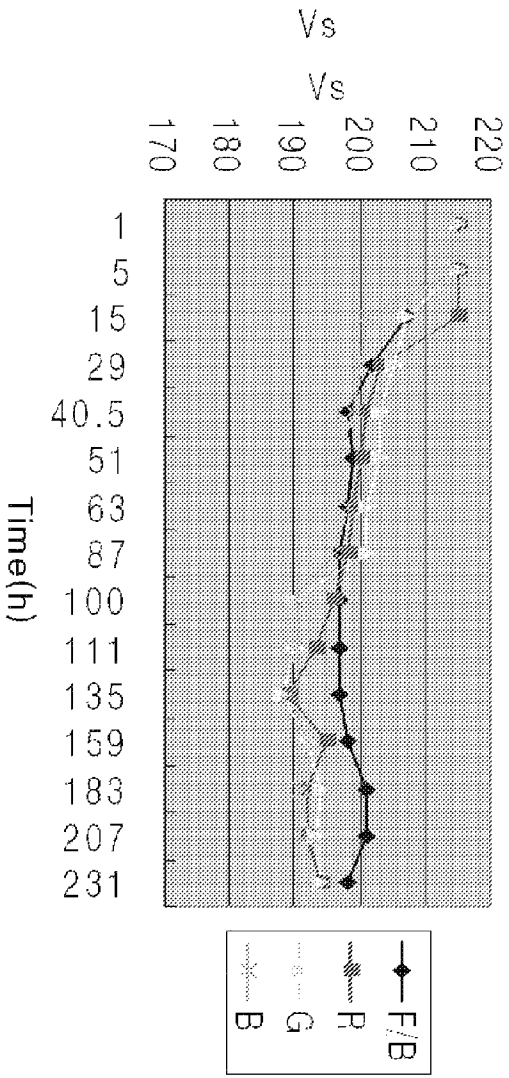
FIG. 6A is a graph illustrating a variation of a spot generation voltage in each RGB discharge cell upon long time driving.

FIG. 6A is a graph illustrating a variation of a spot generation voltage in each RGB discharge cell upon long time driving.

The graph of FIG. 6A is obtained by experimentally driving the plasma display panel with the sustain voltage (Vs) of about 165V, the sustain bias voltage (Vzb) of about 160 V, and the setdown lowest voltage (Vy) of about −90 V. In this experiment, a sum of the absolute value of the setdown lowest voltage and the magnitude of the sustain bias voltage (Vzb) was about 250 V. The sum was greater than 247.5 V, which is 1.5 times of the sustain voltage (Vs) of 165 V. Accordingly, the residual image spot could be generated in this experiment.

In this experiment, after a specific pattern was outputted for a predetermined time, it was observed whether the residual image spot was generated while the pattern was changed.

Red (R) line represents a variation of the spot generation voltage in an R discharge cell. Green (G) line represents a variation of the spot generation voltage in a G discharge cell. Blue (B) line represents a variation of the spot generation voltage in a B discharge cell.

F/B denotes a variation of the spot generation voltage in a Full Black (F/B) screen.

Referring to FIG. 6A, the spot is generated at an initial panel driving time only if the sustain voltage should be applied about 215 V or more. Thus, the discharge is not induced and the spot is not generated besides the case where the data pulse is applied, thereby inducing the address discharge. In other words, though the sustain pulse with the sustain voltage of about 165 V is applied, the sustain pulse does not generate the spot as long as the address discharge is not induced.

However, as the panel is driven for a long time, the spot generation voltage gradually reduces in each discharge cell. That is, when the panel is driven for a long time, a panel temperature increases and thus, the wall charge distribution gradually is out of an initially set range in each period including the reset period, thereby varying a discharge initiation voltage in each discharge cell.

In FIG. 6A, as time lapses, the discharge initiation voltage reduces up to about 190 V or less. When the panel is driven for a longer time beyond the experimental range, the discharge initiation voltage reduces up to the sustain voltage of 165 V.

The discharge should be performed using the sustain pulse applied in the sustain period, only in the discharge cell where the data pulse was applied and thus the address discharge was induced in the address period. However, if the spot generation voltage reduces in each discharge cell as above, the discharge is induced by the sustain pulse, thereby generating the spot, though the data pulse is not applied. This spot is called the residual image spot. This results from an unwanted discharge, and its prevention is required.

Figure 6B:
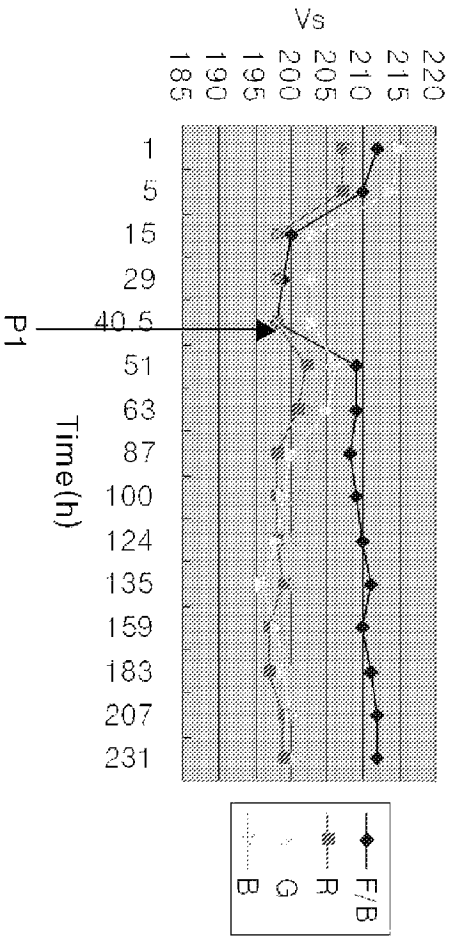
FIG. 6B is a graph illustrating a variation of a spot generation voltage depending on adjustment of a setdown lowest voltage according to the present invention.

FIG. 6B is a graph illustrating a variation of the spot generation voltage depending on adjustment of the setdown lowest voltage according to the present invention.

Referring to FIG. 6B, the setdown lowest voltage (Vy) was adjusted from −90 V to −85 V when 4.05 hours lapsed since the panel was driven.

In this case, the difference between the setdown lowest voltage (Vy) and the sustain bias voltage (Vzb) was about 245 V. This is lower than 247.5 V that is 1.5 times of the sustain voltage (Vs) of 165 V. Thus, the spot generation voltage again increases in each discharge cell. In other words, though the spot generation voltage again increases and long time driving is performed, the spot can be prevented from being generated due to the sustain pulse.

Figure 7A:
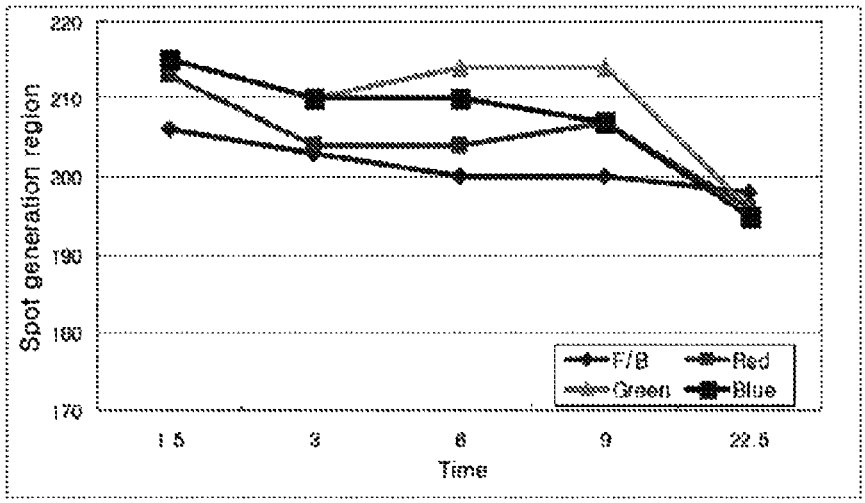
FIGS. 7A to 7C are graphs obtained by measuring a spot generation voltage based on a variation of a sustain bias voltage and a setdown lowest voltage.
Figure 7B:
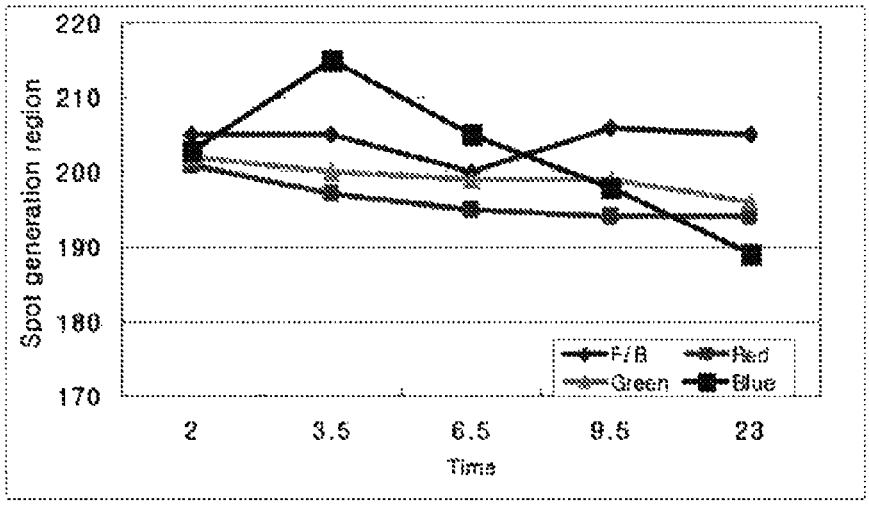
Figure 7C:
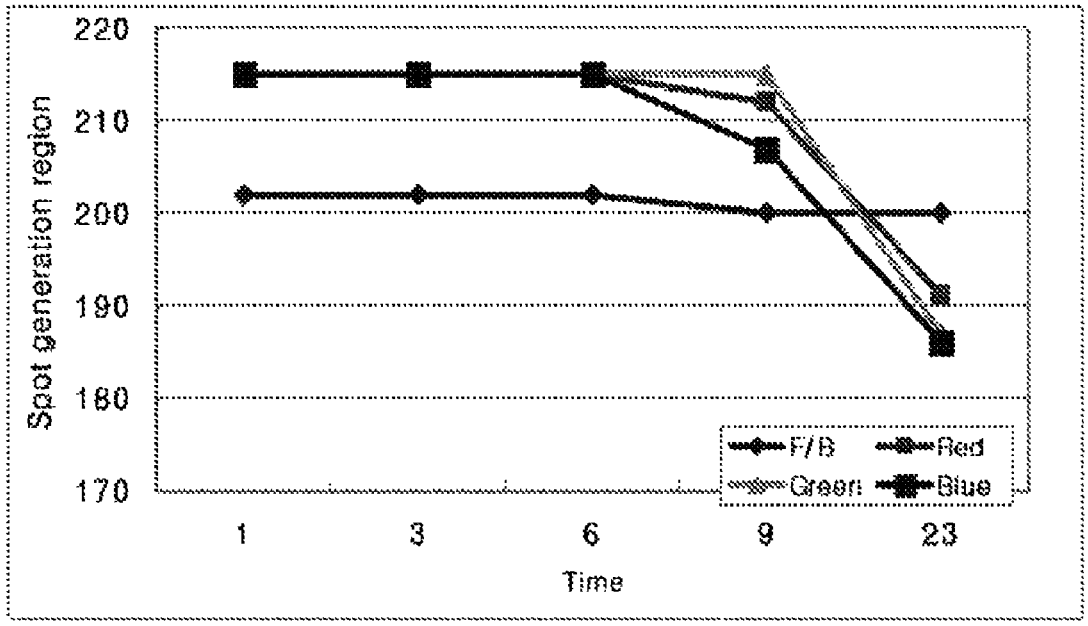

FIGS. 7A to 7C are graphs obtained by measuring the spot generation voltage based on the variation of the sustain bias voltage and the setdown lowest voltage. In FIGS. 7A to 7C, the sustain voltage (Vs) commonly is 165 V, and the graphs are obtained by measuring the spot generation voltage based on the variation of the sustain bias voltage (Vzb) and the setdown lowest voltage (Vy).

FIG. 7A is the graph obtained when the sustain bias voltage (Vzb) is about 145 V and the setdown lowest voltage (Vy) is about −110 V.

Referring to FIG. 7A, it was observed that the spot generation voltage fell from about an initial 215 V to 200V or less in all the R, G, B discharge cells, when 22.5 hours lapsed since the plasma display panel was driven. In case where the panel is continuously driven for a long time, it can be expected that the spot generation voltage falls to the sustain voltage (Vs) or less. In that case, the spot can be generated only by the sustain discharge based on the sustain pulse.

FIG. 7B is the graph obtained when the sustain bias voltage (Vzb) is about 155 V and the setdown lowest voltage (Vy) is about −100V.

Referring to FIG. 7B, it was observed that the spot generation voltage fell from about an initial 205 V to 200V or less in the R, G discharge cells, when 23 hours lapsed since the plasma display panel was driven. Particularly, it was observed that the spot generation voltage fell to 190V or less in the B discharge cell. Similarly, in case where the panel is continuously driven for a long time, it can be expected that the spot generation voltage falls to the sustain voltage (Vs) or less. In that case, the spot can be generated only by the sustain discharge based on the sustain pulse.

FIG. 7C is the graph obtained when the sustain bias voltage (Vzb) is about 165 V and the setdown lowest voltage (Vy) is about −90V.

Referring to FIG. 7C, it was observed that the spot generation voltage was stable until 6 hours lapsed since the plasma display panel was driven, but the spot generation voltage rapidly reduced in the R, G, B discharge cells at a time point when 23 hours lapsed after the 6 hours. It was observed that the spot generation voltage of each discharge cell rapidly fell from about an initial 215 V to 190 V or less. Similarly, in case where the panel is continuously driven for a long time, it can be expected that the spot generation voltage falls to the sustain voltage (Vs) or less. In that case, the spot can be generated only by the sustain discharge based on the sustain pulse.

Figure 8A:
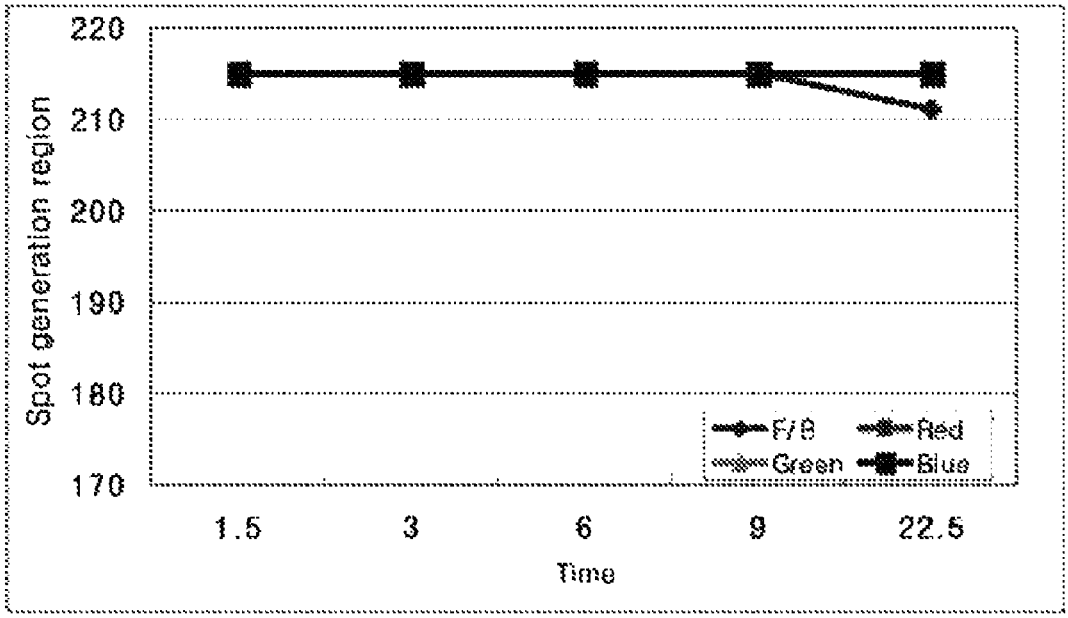
FIGS. 8A to 8C are graphs obtained by measuring a spot generation voltage after adjusting a sustain bias voltage and a setdown lowest voltage according to the present invention.
Figure 8B:
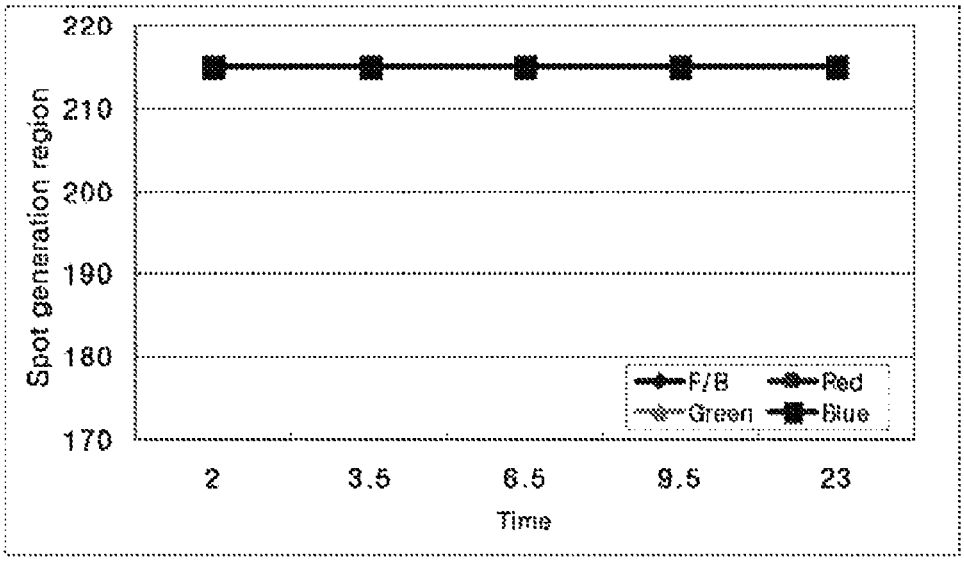
Figure 8C:
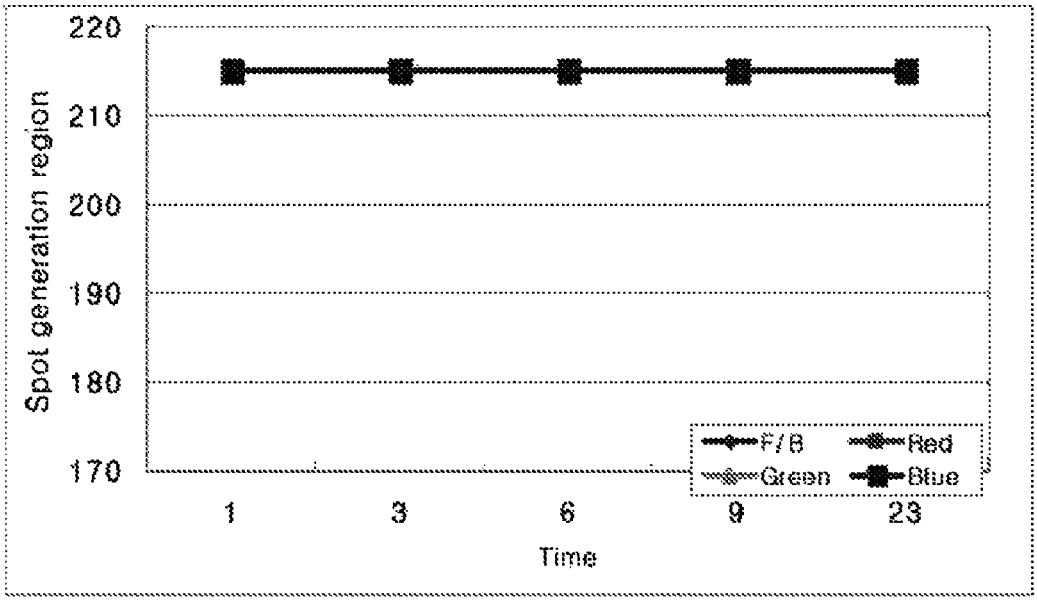

FIGS. 8A to 8C are graphs obtained by measuring the spot generation voltage after adjusting the sustain bias voltage and the setdown lowest voltage according to the present invention. In FIGS. 8A to 8C, the sustain voltage (Vs) commonly is 165 V, and the graphs are obtained by measuring the spot generation voltage after adjusting the sustain bias voltage (Vzb) and the setdown lowest voltage (Vy).

In FIGS. 8A to 8C, the voltage difference between the sustain bias voltage (Vzb) and the setdown lowest voltage (Vy) is within a range of about 1.2 Vs to 1.5 Vs.

FIG. 8A is the graph obtained when the sustain bias voltage (Vzb) is about 145 V and the setdown lowest voltage (Vy) is about −100 V.

Referring to FIG. 8A, it could be appreciated that the spot generation voltage had no great change though time lapses to some degree. However, a spot generation voltage of a full black (F/B) line begun to reduce little by little after 9 hours lapsed, but the spot generation voltages of the R, G, B discharge cells were stable without a great change.

FIG. 8B is the graph obtained when the sustain bias voltage (Vzb) is about 155 V and the setdown lowest voltage (Vy) is about −90 V. FIG. 8C is the graph obtained when the sustain bias voltage (Vzb) is about 165 V and the setdown lowest voltage (Vy) is about −80 V.

The spot generation voltages were sustained by 210 V or more, and were stable in all FIGS. 8A to 8C.

As described above, the residual image spot is generated by the difference between the scan electrode (Y), which is the first electrode, and the sustain electrode (Z), which is the second electrode. Thus, the residual image spot can be improved if the difference between the setdown lowest voltage (Vy) and the sustain bias voltage (Vzb) is limited to a predetermined range according to the present invention.

Particularly, the wall charges are sufficiently generated in amount in the discharge cell and the setdown signal (R_dn) and the sustain bias voltage (Vzb) are applied for the purpose of the voltage compensation, after execution of the reset discharge based on the setup reset signal (R_up). Therefore, when the difference between the setdown lowest voltage (Vy) and the sustain bias voltage (Vzb) is too great or small, it influences the wall charge distribution within the discharge cell, thereby inducing the sustain discharge even in the discharge cell where the address discharge is not induced.

Thus, in the plasma display apparatus according to the present invention, the difference between the setdown lowest voltage (Vy) and the sustain bias voltage (Vzb) can be set within the range of about 1.2 Vs to 1.5 Vs after the reset discharge, thereby suppressing the erroneous discharge.

In addition, in case where the difference between the setdown lowest voltage (Vy) and the sustain bias voltage (Vzb) is limited according to the present invention, the spot generation voltage is sustained more than the driving voltage, thereby greatly improving the residual image spot, though the plasma display panel is driven for a long time.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a first electrode and a second electrode formed in parallel on an upper substrate; and a third electrode formed on a lower substrate to intersect with the first electrode and the second electrode, wherein a driving signal is applied to the first electrode, the second electrode, and the third electrode in a reset period, an address period, and a sustain period per one subfield, wherein the reset period comprises a setdown period, and wherein a difference between a setdown lowest voltage of the driving signal applied to the first electrode and a voltage applied to the second electrode in the setdown period is 1.2 times to 1.5 times of a sustain voltage.

2. The plasma display apparatus of claim 1, wherein an absolute value of the setdown lowest voltage is half of or less than half of the sustain voltage.

3. The plasma display apparatus of claim 1, wherein an absolute value of the setdown lowest voltage is greater than an absolute value of a scan pulse voltage.

4. The plasma display apparatus of claim 1, wherein an absolute value of the voltage applied to the second electrode is the sustain voltage or less.

5. The plasma display apparatus of claim 1, wherein the difference between the setdown lowest voltage and the voltage applied to the second electrode is within a range of 220 V to 260 V.

6. The plasma display apparatus of claim 1, wherein the voltage applied to the second electrode is a ground voltage.

7. The plasma display apparatus of claim 1, wherein the setdown lowest voltages are different from each other in two arbitrary subfields.

8. A plasma display apparatus comprising:

a first electrode and a second electrode formed in parallel on an upper substrate; and a third electrode formed on a lower substrate to intersect with the first electrode and the second electrode, wherein a driving signal is applied to the first electrode, the second electrode, and the third electrode in a reset period, an address period, and a sustain period per one subfield, and wherein the reset period is comprised of only a setdown period without a setup period, whereby a difference between a setdown lowest voltage of the driving signal applied to the first electrode and a voltage applied to the second electrode in the setdown period is 1.2 times to 1.5 times of a sustain voltage.

9. The plasma display apparatus of claim 8, wherein the driving signal applied to the first electrode ramps down from the sustain voltage in initiation of the setdown period.

10. The plasma display apparatus of claim 8, wherein an absolute value of the setdown lowest voltage is half of or less than half of the sustain voltage.

11. The plasma display apparatus of claim 8, wherein an absolute value of the setdown lowest voltage is greater than an absolute value of a scan pulse voltage.

12. The plasma display apparatus of claim 8, wherein an absolute value of the setdown lowest voltage is the same as an absolute value of a scan pulse voltage.

13. The plasma display apparatus of claim 8, wherein an absolute value of the voltage applied to the second electrode is the sustain voltage or less.

14. The plasma display apparatus of claim 8, wherein the voltage applied to the second electrode is a ground voltage.

15. The plasma display apparatus of claim 8, wherein the setdown lowest voltages are different from each other in two arbitrary subfields.

16. A plasma display apparatus comprising:

a first electrode and a second electrode formed in parallel on an upper substrate; and a third electrode formed on a lower substrate to intersect with the first electrode and the second electrode, wherein a driving signal is applied to the first electrode, the second electrode, and the third electrode in a reset period comprising a setdown period, an address period, and a sustain period per one subfield, wherein a difference between a setdown lowest voltage of the driving signal applied to the first electrode and a voltage applied to the second electrode in the setdown period is 1.2 times to 1.5 times of a sustain voltage, and wherein the setdown lowest voltage is substantially the same as a scan pulse voltage.

17. The plasma display apparatus of claim 16, wherein an absolute value of the setdown lowest voltage is half of or less than half of the sustain voltage.

18. The plasma display apparatus of claim 16, wherein an absolute value of the voltage applied to the second electrode is the sustain voltage or less.

19. The plasma display apparatus of claim 16, wherein the voltage applied to the second electrode is a ground voltage.

20. The plasma display apparatus of claim 16, wherein the setdown lowest voltages are different from each other in two arbitrary subfields.

* * * * *